United States Patent [19]

Hirschmann

[11] 4,171,944

[45] Oct. 23, 1979

[54] COMBINED SMOKE DETECTION AND FURNACE SHUT OFF DEVICE

[75] Inventor: Jack B. Hirschmann, c/o H. L. Bouton Company, Buzzards Bay, Mass. 02532

[73] Assignee: Jack B. Hirschmann, Buzzards Bay, Mass.

[21] Appl. No.: 829,880

[22] Filed: Sep. 1, 1977

[51] Int. Cl.[2] ..... F23N 5/24

[52] U.S. Cl. ..... 431/22; 431/76

[58] Field of Search ..... 431/16, 18, 22, 76; 340/237 S

[56] References Cited

U.S. PATENT DOCUMENTS

| | | | |
|---|---|---|---|
| 2,727,203 | 12/1955 | Zeitlin et al. | 340/237 S |
| 2,843,198 | 7/1958 | Beckett | 431/265 |
| 3,884,133 | 5/1975 | Miller | 236/49 |
| 3,955,186 | 5/1976 | Green et al. | 340/237 R |

*Primary Examiner*—Carroll B. Dority, Jr.

*Attorney, Agent, or Firm*—Biebel, French & Nauman

[57] ABSTRACT

A combined smoke detection and furnace shut-off device is provided having a smoke detection means which is disposable adjacent a furnace for detecting the presence of smoke unnaturally emitted from the furnace, a means for stopping ignition within the furnace, and means responsive to detection of the smoke by said smoke detection means for activating the ignition stopping means.

7 Claims, 1 Drawing Figure

COMBINED SMOKE DETECTION AND FURNACE SHUT OFF DEVICE

BACKGROUND OF THE INVENTION

1. Field of the Invention

The present invention relates to furnace control apparatus, and more particularly, to means for detecting the existence of a dangerous condition of fuel combustion in a furnace.

2. Prior Art

It is well known that malfunctioning furnaces can create an explosive situation which may result in severe damage to the furnace and even the dwelling or other structure in which it is housed. Many devices have been designed for detecting certain well known conditions which can create such an explosive condition within a furnace.

For example, devices such as that disclosed by Hobbs U.S. Pat. No. 2,874,763 and Fehrenbach U.S. Pat. No. 2,283,496, are intended to detect the absence of a flame within the furnace and as a result shut off fuel supply to the furnace so that an excess of fuel does not accumulate in the bottom of the furnace which might otherwise result in an explosion upon subsequent ignition. In addition, Hobbs discloses a system for shutting off the pilot light and main fuel supply lines in order to prevent additional accumulation of fuel within the furnace. A further control feature of Hobbs prevents ignition of the pilot light when a heavy mist or smoke condition exists within the furnace chamber.

However, such devices although effective in sensing the absence of a flame or the presence of a dangerous condition existing within the furnace prior to ignition, can still permit continuous operation of the furnace, particularly oil burning furnaces and the like, under circumstances which can cause severe smoke damage to a dwelling. Such a condition can exist, for example when the air supply to the furnace combustion chamber is insufficient to permit complete combustion of the fuel. Under such circumstances, although the furnace will continue to operate, substantial amounts of smoke will be produced which can be expelled from openings in the furnace other than the flue and thus not only cause substantial damage to the building and furnishings, but also constituting severe hazard to the life and health of the occupants.

The use of well known smoke detecting devices which provide an alarm, for example, such as disclosed in Webb U.S. Pat. No. 4,004,288 and Franks U.S. Pat. No. 4,001,800, can provide an alert to the presence of such a dangerous condition existing in the furnace when smoke is unnaturally expelled therefrom into the room containing the furnace. However, unknolwedgeable home owners, for example, would not be aware of the necessity of turning off the fuel supply in order to stop the smoke emmission, and therefore such devices are generally unsatisfactory for such an application.

SUMMARY OF THE INVENTION

The present invention overcomes the above described difficulties and disadvantages associated with prior art devices by providing a combined smoke detection and furnace shut-off device which includes a means for detecting smoke located adjacent a furnace in such a manner that it can detect the presence of smoke being unnaturally emitted from the furnace, a means for stopping the ignition of fuel within the furnace, and means responsive to detection of smoke by the smoke detection means for activating the means for stopping ignition of the furnace.

In its preferred form, the smoke detection device can be any one of numerous available devices of, for example, the photo electric or ionization types, which can be positioned in the furnace room adjacent the furnace so that the presence of smoke being emitted, for example, from the door of the furnace rather than out through the flue, will be immediately detected. The smoke detection device upon sensing presence of smoke produces an output signal which is utilized to shut off the ignition means as well as the fuel supply to the furnace.

DETAILED DESCRIPTION OF THE PREFERRED EMBODIMENT

Figure 1:
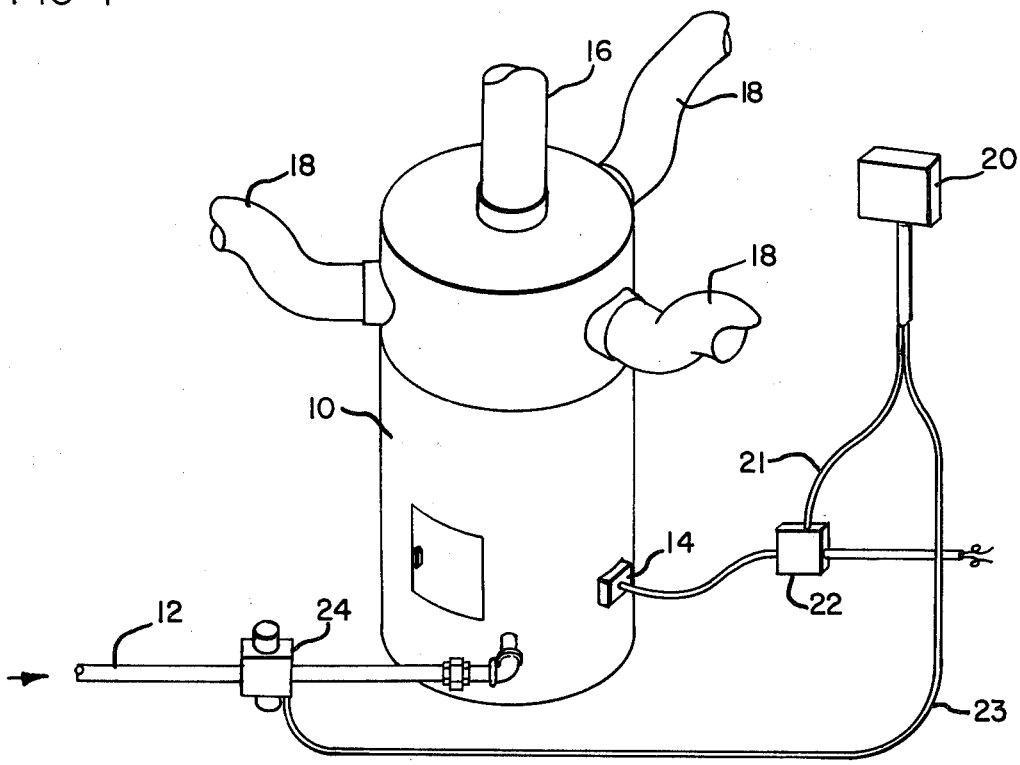
FIG. 1 is a pictorial illustration of a system utilizing the preferred embodiment of the present invention connected to a conventional oil burning furnace.

As shown somewhat schematically in FIG. 1, the system of the present invention is associated with an oil burning furnaces 10 of conventional construction which is supplied with oil through supply line 12 and is provided with an electrode spark ignition device 14 of conventional construction which maintains a constant electric arc within the furnace chamber in order to ignite the oil coming from the supply line 12. The exhaust gases normally escape through the flue pipe 16, and the heated air is circulated through the building by hot air ducts 18.

A smoke detection device 20, also of conventional construction such as those disclosed in the above referred to Webb and Franks patents, is secured to the wall or ceiling of the furnace room adjacent the furnace 10, or in one of the hot air ducts. It is so positioned as to detect the presence of smoke unnaturally expelled from the furnace into the furnace room or into the hot air ducts. For example, smoke may be emitted through the furnace door or other openings in the furnace which, although not completely sealed, generally do not permit the escape of smoke due to the draft during normal combustion which causes the smoke to pass out normally through the flue pipe 16.

However, when a condition exists within the furnace which will permit only partial combustion of the fuel oil, the black, sooty smoke produced will not be drawn out through the flue because of a decrease in the draft. It will therefore escape into the furnace room and the rest of the building, causing substantial damage.

Smoke detection device 20 provides an electrical signal output through lead wire 21 which is utilized to activate an electrical relay 22 connected to the ignition electrodes 14, in such a manner that a signal from the smoke detection device 20, which is generated due to the presence of smoke, will shut off the electrical supply to the electrode spark ignition device 14 and thus stop ignition of the oil within the furnace chamber. In addition, the signal output generated by the smoke detection device 20 is also connected by lead wire 23 to a solenoid valve 24 in the supply line so that supply of fuel to the furnace chamber will also be shut off upon the smoke detection device 20 sensing the presence of smoke. Alternatively, the lead wire 23 could connect with the control switch of the supply pump for an oil burner, for the purpose of cutting off the electric power to the pump as one way of terminating ignition of fuel within the furnace by shutting off the fuel supply to the burner.

It is contemplated that although the preferred embodiment is described as shutting off both the electrical input to electrode spark ignition device 20 and the fuel supply input through supply line 12 simultaneously, either one could shut off alone. However, by shutting off both the ignition device and the source of supply of fuel, combustion of fuel within the combustion chamber will be stopped more quickly.

It is also contemplated that although the preferred embodiment of the present invention is described in connection with an oil burning furnace, other fuel sources such particularly as gas, can result in the same undercombustion condition and thus produce smoke in the same manner as oil burning furnaces, and therefore the system of the present invention could likewise be utilized for furnaces burning such other types of fuel. Since some of these systems utilize a pilot light as opposed to an electrode ignition system, it is further contemplated that a cut off means for the supply of fuel to the pilot light as well as supply of the main burning fuel should be provided.

While the form of apparatus herein described constitute a preferred embodiment of the invention, it is to be understood that the invention is not limited to this precise form of apparatus, and that changes may be made therein without departing from the scope of the invention.

What is claimed is:

1. A combined smoke detection and furnace shut-off device, comprising:

a furnace having an ignition device and a fuel supply means:

smoke detection means located in a room surrounding said furnace for detecting the presence of smoke unnaturally emitted from said furnace;

means for stopping said ignition device; and means responsive to detection of smoke by said smoke detection means for activating said ignition stopping means.

2. A device as defined in claim 1 wherein said smoke detection means includes ionization detection means for producing an output indicative of sensed smoke, said ionization detection means activating said responsive means at a predetermined level of sensed smoke.

3. A device as defined in claim 2 including fuel supply shut-off means for stopping the supply of fuel to the furnace in response to said smoke detection means.

4. A device as defined in claim 3 wherein said responsive means is an electric circuit means for receiving a signal from said ionization detection means upon reaching said predetermined level of sensed smoke and supplying a signal to said ignition stopping means so as to activate the same.

5. A device as defined in claim 1 wherein said smoke detection means includes optical smoke detection means for producing an output indicative of sensed smoke, said optical smoke detection means activating said responsive means at a predetermined level of sensed smoke.

6. A device as defined in claim 6 including fuel supply shut-off means for stopping the supply of fuel to the furnace responsive to said smoke detection means.

7. A device as defined in claim 7 wherein said responsive means is an electric circuit means for receiving a signal from said optical smoke detection means upon reaching said predetermined level of sensed smoke and supplying a signal to said ignition stopping means so as to activate the same.

* * * * *